United States Patent [19]

Nagahiro et al.

[11] Patent Number: 4,656,977

[45] Date of Patent: Apr. 14, 1987

[54] OPERATING MECHANISM FOR DUAL VALVES IN AN INTERNAL COMBUSTION ENGINE

[75] Inventors: Kenichi Nagahiro; Atsushi Ishida, both of Saitama; Shigemasa Kajiwara, Tokyo, all of Japan

[73] Assignee: Honda Giken Kogyo Kabushiki Kaisha, Tokyo, Japan

[21] Appl. No.: 758,153

[22] Filed: Jul. 23, 1985

[30] Foreign Application Priority Data

Jul. 24, 1984 [JP] Japan ..... 59-153803

[51] Int. Cl.[4] ..... F01L 1/26

[52] U.S. Cl. ..... 123/90.16; 123/90.44; 123/198 F

[58] Field of Search ..... 123/90.16, 198 F, 90.15, 123/90.44

[56] References Cited

U.S. PATENT DOCUMENTS

| | | | |
|---|---|---|---|
| 4,387,680 | 6/1983 | Tsunetomi et al. | 123/198 F |
| 4,516,542 | 5/1985 | Aoyoma et al. | 123/90.16 |
| 4,537,165 | 8/1985 | Honda et al. | 123/90.16 |
| 4,545,342 | 10/1985 | Nakano et al. | 123/90.16 |

*Primary Examiner*—Ira S. Lazarus

*Attorney, Agent, or Firm*—Lyon & Lyon

[57] ABSTRACT

A valve operating mechanism for an internal combustion engine having a pair of intake valves or exhaust valves in each cylinder with a first and a second rocker arm corresponding to the pair of valves and a cam for pivoting the first rocker arm. The rocker arms are provided with a connecting mechanism having a piston assembly which is movable between a position in which both said rocker arms are connected and a position in which both said rocker arms are disconnected from each other whereby either both valves of the pair or only one valve may be selectively actuated. A trigger member in the first rocker arm selectively restricts the movement of the piston and a timing cam engages and actuates the trigger member.

15 Claims, 10 Drawing Figures

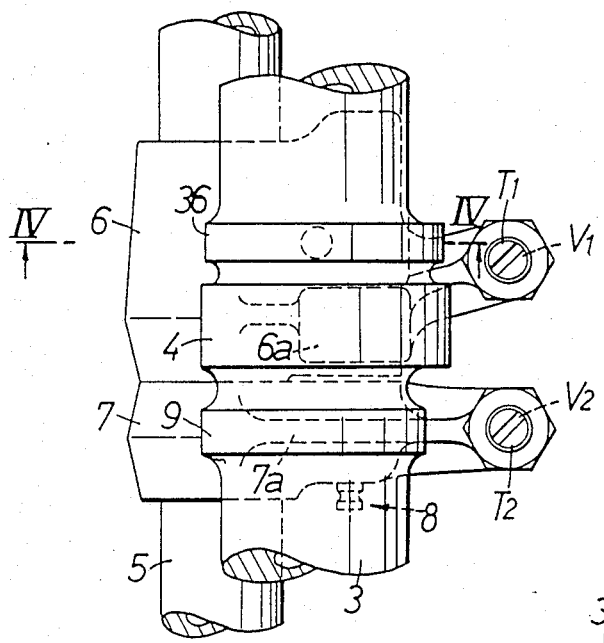
FIG. 1.
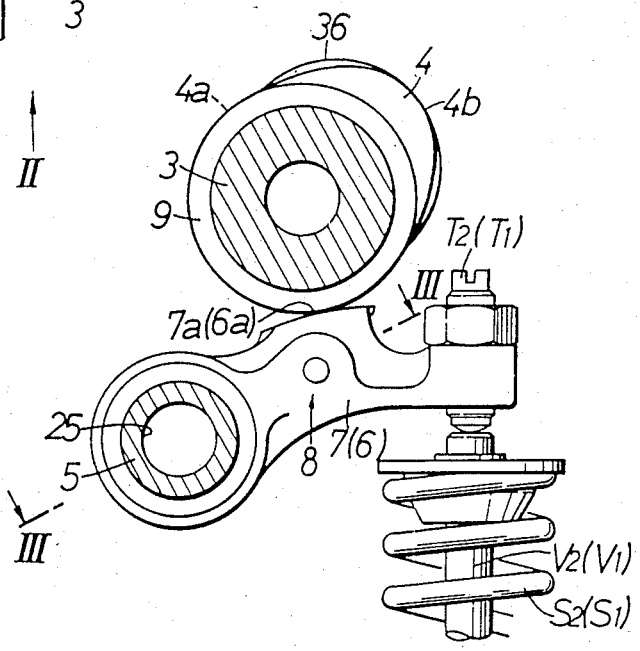
FIG. 2
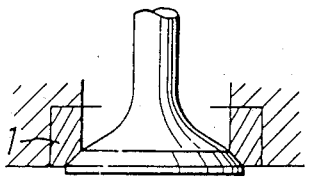

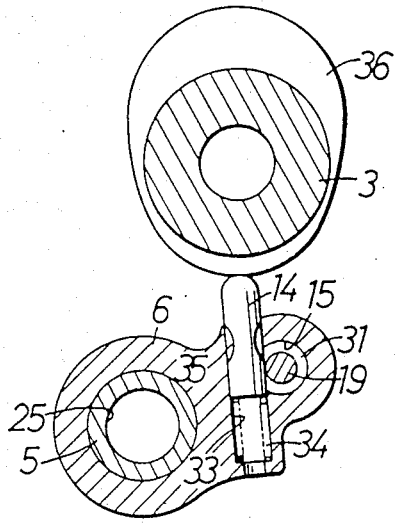
FIG. 4a.
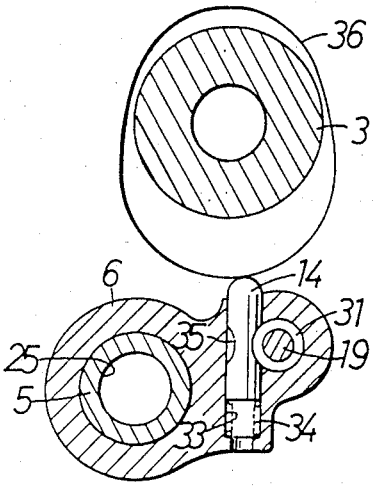
FIG. 4b.
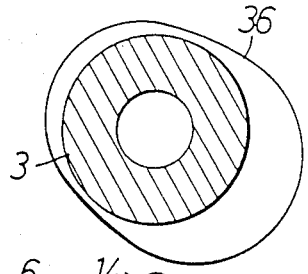
FIG. 4c.
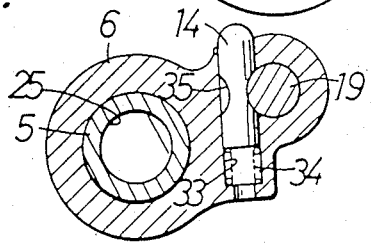
FIG. 5.
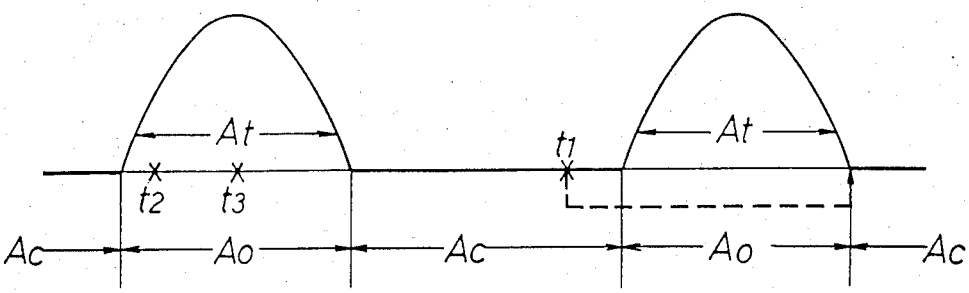

OPERATING MECHANISM FOR DUAL VALVES IN AN INTERNAL COMBUSTION ENGINE

The present invention relates to a valve operating mechanism in an internal combustion engine for selectively operating one or both of a pair of intake valves or exhaust valves under certain operating conditions and, in particular, a mechanism to efficiently and effectively accomplish the change from one to both valves and back to one valve.

There have been valve operating mechanism proposed previously for selectively operating one or both of a pair of valves, either intake or exhaust, for each cylinder of the engine depending on the operation of the engine, such as operating one valve at low engine speeds for maximum efficiency and normal idling and operating both valves at high engine speeds for maximum performance. One such system uses a rocker arm for each valve of the pair with only one of the rocker arms engaging the camshaft and a device for connecting and disconnecting the rocker arms for selectively operating both or one of the valves, respectively. In changing the state of connection between the rocker arms, it is necessary that both rocker arms be in a non-pivoting mode, that is, that the cam engaging one of the rocker arms be in an angular position that is not causing pivoting of the rocker arm. For example, in changing over from a state in which only one intake valve or exhaust valve is operated to a state in which both intake valves or both exhaust valves are operated, it is assumed that the movement of the connecting mechanism is started at a time point t1 in an intake valve or exhaust valve closed section Ac, namely, in a section in which the first rocker arm is stationary in sliding contact with the base circle of the cam, as shown in FIG. 5, the valve opening section Ao, namely, the first rocker arm pivoting section starts soon thereafter and it becomes difficult for the connecting device to engage the second rocker arm. Even if the engagement is made to a slight degree, it may be released thereby making a positive change-over impossible. Moreover, since an automotive internal combustion engine has multiple cylinders, the timing of the connection between rocker arms cannot be simultaneous for all the cylinders without encountering this change-over problem unless the actual change over is independently controlled at each cylinder.

It is an object of the present invention to provide an improved valve operating mechanism for an internal combustion engine having a pair of intake or exhaust valves for each cylinder wherein one or both of the pair of valves may be selectively operated and the change in operation is effectively accomplished in the most desirable portion of the cycle. A further object of this invention is to provide such a mechanism wherein the change in operating state is accomplished by a moving piston but the movement is timed by a trigger device which is always actuated at the same time in the cycle.

Other and more detailed objects and advantages of this invention will appear from the following description and the accompanying drawings, wherein:

FIG. 1 is a plan view of a portion of the valve operating mechanism of an internal combustion engine with a pair of intake valves in one cylinder.

FIG. 2 is an elevation view of the valve operating mechanism of this invention with portions shown in section.

Figure 3A:
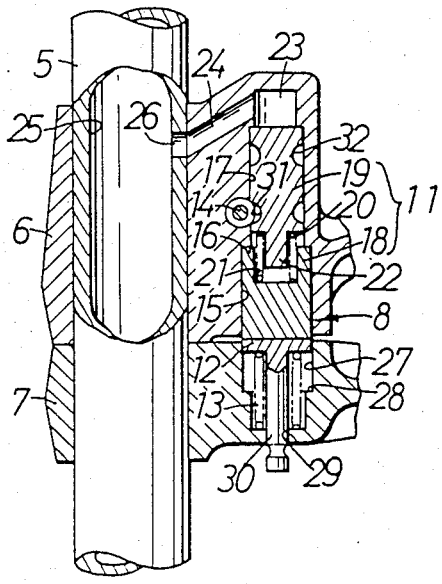

FIGS. 3*a*, 3*b*, 3*c* and 3*d* are sectional plan views taken substantially on the line III—III in FIG. 2 and illustrating the various operating conditions of the apparatus of this invention.

FIGS. 4*a*, 4*b* and 4*c* are sectional elevation views taken substantially on the line IV—IV in FIG. 1 and illustrate the various operating conditions of the trigger mechanism of the apparatus of this invention.

FIG. 5 is a graph of the valve operating cycle with the valve position plotted against time to illustrate the timing of the change-over in operating condition.

Referring now in further detail to the drawings, the invention will be described in connection with a pair of intake valves V1 and V2 but it will readily appear to those skilled in the art that the invention is equally applicable to a pair of exhaust valves. First, as shown in FIGS. 1 and 2, a pair of intake valves V1 and V2 are provided in an engine body 1 and are urged in a valve closing direction by valve springs S1 and S2. The intake valves V1 and V2 are opened and closed in a change-over fashion between a state in which only one intake valve V1 is operated and a state in which both intake valves V1 and V2 are operated by the cam 4 engaging the first rocker arm 6 and the first and second rocker arms 6 and 7 being selectively connected by the connecting mechanism 8 provided in those rocker arms. The cam 4 is integral with a camshaft 3 which is rotated at a speed ratio of $\frac{1}{2}$ in synchronism with the rotation of the engine crankshaft. The first and second rocker arms 6 and 7 are pivotably supported on a rocker shaft 5 which is parallel to the camshaft 3.

The camshaft 3 is disposed rotatably above the engine body 1, and the cam 4 is integral with the camshaft 3 in a position corresponding to one intake valve V1. The cam 4 has a base circle 4*a* which is concentric with the camshaft 3 and a raised portion or lobe 4*b* which projects radially outwards from the base circle 4*a*. Further, the camshaft 3 is integrally formed with a raised portion 9 of the same diameter as the base circle 4*a* in a position corresponding to the other intake valve V2.

The rocker shaft 5 is fixed below and to one side of the camshaft 3, and a first rocker arm 6 corresponding to one intake valve V1 and a second rocker arm 7 corresponding to the other intake valve V2 are supported by the rocker shaft 5 so as to be angularly displaceable relative to and in sliding contact with each other. To end portions of the rocker arms 6 and 7 positioned above the intake valves V1 and V2 are threadedly attached tappet screws T1 and T2 for adjusting the engagement with the upper ends of the intake valves V1 and V2.

The first rocker arm 6 is integrally provided with a cam slipper 6*a* which is in sliding contact with the cam 4. The first rocker arm 6 pivots according to the rotating motion of the cam 4. More particularly, the first rocker arm 6 is stationary when the cam slipper 6*a* is in sliding contact with the base circle 4*a*, and it pivots downward while compressing the valve spring S1 to open the intake valve V1 when the cam slipper 6*a* comes into sliding contact with the raised portion 4*b*.

The second rocker arm 7 is provided at an upper portion thereof with a slipper 7*a* which is in sliding contact with a raised portion 9. The raised portion 9 is the same diameter as the base circle 4*a* and functions to prevent jumping of the second rocker arm 7 by maintaining it in a stationary state when the rocker arms 6 and 7 are in a disconnected state, namely, when the intake valve V2 is remaining in a closed state.

In FIG. 3*a*, a connecting mechanism 8 is illustrated for effecting connection and disconnection between the first and second rocker arms 6 and 7. The mechanism 8 is provided with a piston assembly 11 movable between a position in which the rocker arms 6 and 7 are connected and a position in which they are disconnected, a plunger 12 for restricting the movement of the piston 11, a spring 13 for urging the plunger 12 into engagement with the piston assembly 11 and in turn toward the disconnected position, and a trigger member 14 for controlling the timing of the movement of the piston 11 assembly.

The first rocker arm 6 is formed with a first guide bore 15 which is open toward the second rocker arm 7 and which is parallel with the rocker shaft 5. On one end of the first guide bore 15 is provided a small-diameter portion 17 through a restricting stepped portion 16 which faces the second rocker arm 7.

The piston assembly 11 is comprised of a short cylinder-like connecting member 18 which is slidably fitted in the large diameter portion of the first guide bore 15, a short cylinder-like extending member 19 which is slidably fitted in the small-diameter portion 17 of the first guide bore 15, and a spring 20 disposed between the connecting member 18 and the extending member 19. A pin portion 22 on extending member 19 fits into the recessed portion 21 projecting integrally from an end face of the connecting member 18. The spring 20 is in the form of a coil which surrounds the pin portion 22 between the bottom of the recessed portion 21 and the end face of the extending member 19. The spring constant for the spring 20 is smaller than that for the spring 13 whereby the spring 20 will be completely compressed before any significant compression of spring 13 occurs when extending member 19 is urged toward plunger 12.

Figure 3B:
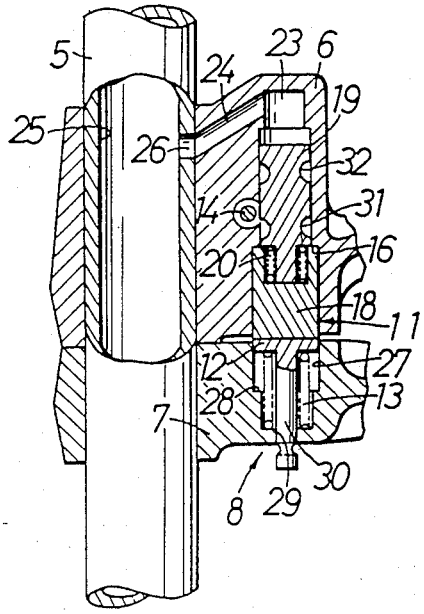

The length of the connecting member 18 is selected so that when one end thereof abuts the restricting stepped portion 16, the other end face thereof is positioned between opposed side faces of the first and second rocker arms 6 and 7 as shown in FIGS. 3*a* and 3*b*. Further, the diameter of the recessed portion 21 is selected so that an end face of the connecting member 18 can abut the opposed end face of the extending member 19, and the length of the pin portion 22 is selected so as to permit the abutment between the end faces of the connecting member 18 and extending member 19.

An oil pressure chamber 23 is formed between the closed end of the first guide bore 15 and the extending member 19 and an oil passage 24 is formed in the first rocker arm 6 in communication with the oil pressure chamber 23. Moreover, the rocker shaft 5 is formed with a oil passage 25 for a continuous supply of oil from an oil pressurizing source (not shown) and a communication hole 26 is provided in the side wall of rocker shaft 5 and communicates with the oil passage 25. The communication hole 26 has a shape which ensures communication with the oil pressure chamber 23 in all positions of the first rocker arm 6.

The second rocker arm 7 is formed with a second guide bore 27 which is the same size as and in axial alignment with the first guide bore 15 and which is open in the direction of the first rocker arm 6. The plunger 12 is slidably fitted in the second guide bore 27. The plunger 12, formed in the shape of a disc, is slidable within the second guide bore 27 until it comes into abutment with a restricting stepped portion 28 facing the first rocker arm 6. Further, a hole 29 is formed in the bottom of the second guide bore 27 and a guide rod 30 portion of the plunger 12 extends through the hole 29, thereby causing the plunger 12 to slide coaxially with the second guide bore 27.

Between the bottom of the second guide bore 27 and the plunger 12 is disposed the spring 13 which is in the form of a coil surrounding the guide rod 30. The plunger 12 is urged in the direction of abutment with the piston assembly 11 by the biasing force of the spring 13.

A pair of annular engaging grooves 31 and 32 are formed in the outer surface of the extending member 19 in axially spaced positions. The trigger member 14 is engageable with the engaging grooves 31 and 32 in a manner hereinafter described. Referring now to FIG. 4*a*, a vertically extending slide-fitting hole 33 is formed in the upper surface of the first rocker arm 6 so that a part of its side face intersects and faces the first guide bore 15. The hole 33 is located in a position corresponding to one engaging groove 31 at the extreme position of movement of the extending member 19 toward the oil pressure chamber 23. The trigger member 14 has a round rod-like shape and is slidably fitted in the hole 33. Further, a spring 34 is disposed between the end of trigger member 14 and the bottom of the slide-fitting hole 33 for urging the trigger member 14 to project in the direction toward the camshaft 3.

An annular groove 35 is formed in the outer surface of the trigger member 14 for receiving the outer surface of the extending member 19 to permit unrestricted sliding movement of the extending member when the trigger member is pushed down to its lowest position, as shown in FIG. 4*b*.

The position of the other engaging groove 32 in the extending member 19 is designed so that the groove comes to the position corresponding to the trigger member 14 when the extending member 19 moves to the maximum limit toward the second rocker arm 7 for connecting the first and second rocker arms 6 and 7.

A timing cam 36 is integral with the camshaft 3 in a position corresponding to the trigger member 14. The trigger member 14 is in resilisent sliding contact with the timing cam 36, so it slides up and down within the slide-fitting hole 33 in accordance with the rotating motion of the timing cam 36. The shape of the timing cam 36 is designed so that as the first rocker arm 6 pivots in the valve opening direction, the trigger member 14 is forced down against the biasing force of the spring 34 to a position for receiving the outer surface of the extending member 19 in the groove 35 and release the engagement of the extending member 19 and the trigger member 14.

Operation of this embodiment of the invention will now be explained. When there is no oil pressure acting on the oil pressure chamber 23, the connecting member 18 of the piston assembly 11 is urged upwardly into abutment with the restricting stepped portion 16 by the plunger 12 and spring 13 and the extending member 19 is displaced to the maximum limit toward the oil pressure chamber 23 by the spring 20, as shown in FIG. 3*a*. In this state, the engaging groove 31 is located in a position corresponding to the trigger member 14. Therefore, in a stationary state of the first rocker arm 6, the trigger member 14 projects upward and engages the engaging groove 31 of the pressing member 19 as shown in FIG. 4*a*. When the first rocker arm 6 is pivoted in the valve opening direction by cam lobe 4*b*, the trigger member 14 is forced down by the timing cam 36 to a position where the groove 35 is aligned with the extending member 19 to permit movement of the latter, as shown in FIG. 4*b*. At this time, the connecting member 18 of the piston assembly 11 and the plunger 12 are in abutment with each other between opposed side faces of the first and second rocker arms 6 and 7, as shown in FIG. 3*b*, and the first rocker arm 6 pivots while maintaining the connecting member 18 and the plunger 12 in sliding contact with each other to operate only one intake valve V1. The second rocker arm 7 remains stationary to maintain the other intake valve V2 in a closed state.

Assuming that oil pressure is exerted on the oil pressure chamber 23 at time point t1, as shown in FIG. 5, the extending member 19 of the piston assembly 11 is urged to start moving but movement is impossible because the trigger member 14 is in engagement with the engaging groove 31 and therefore the piston assembly 11 remains in the state shown in FIG. 3*a*. In this state, when the first rocker arm 6 starts pivoting in the valve opening direction, namely, when the valve opening section Ao starts, the trigger member 14 is actuated by the cam 36 and becomes disengaged from the extending member 19 as shown in FIG. 4*b*. As a result, the extending member 19 moves until it comes into abutment with the connecting member 18 while compressing the spring 20 as shown in FIG. 3*b*. At this time, the groove 35 of the trigger member 14 is positioned on the outer surface of the extending member 19 and thus the movement of the extending member 19 is not prevented, as shown in FIG. 4*c*.

Figure 3C:
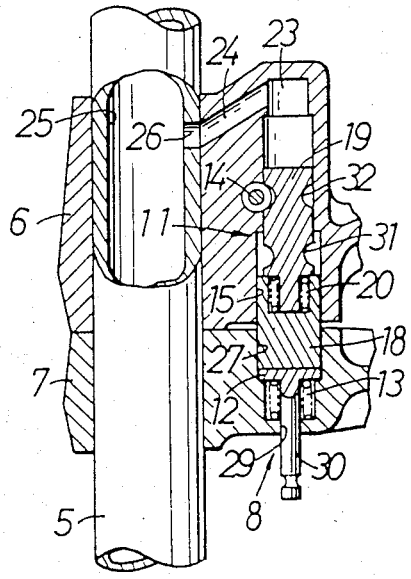

Next, upon alignment of the first and second guide bores 15 and 27, namely, when the first rocker arm 6 becomes stationary and the valve closing section Ac starts, the piston assembly 11 moves downwardly, as shown in FIG. 3*c*. As a result, the connecting member 18 slides into the guide bore 27, whereby the first and second rocker arms 6 and 7 are connected through the connecting mechanism 8, so that the second rocker arm 7 starts pivoting together with the first rocker arm 6 to operate the intake valves V1 and V2. In the completed state of this connection, the engaging groove 32 of the extending member 19 is in the position corresponding to the trigger member 14, and in the valve closed section Ac of the cycle the trigger member 14 engages the engaging groove 32.

Figure 3D:
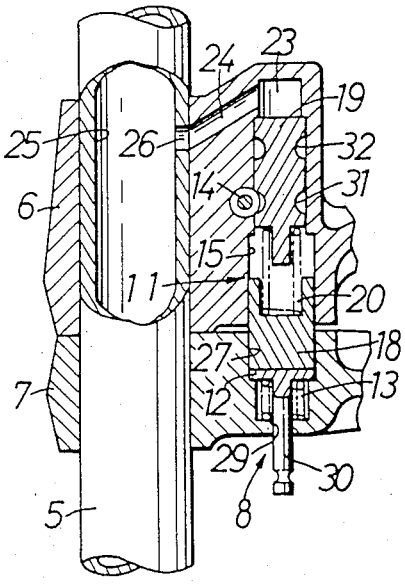

Assuming the oil pressure in the oil pressure chamber 23 is released at time point t1 in the valve closed section Ac, the piston assembly 11 is urged in a direction toward the chamber 23 leaving the second guide bore 27 by the spring 13, but its movement is prevented because the trigger member 14 is in engagement with the engaging groove 32. When the valve opening section Ao starts, the trigger member 14 is forced down in accordance with a pivoting motion of the first rocker arm 6 and becomes disengaged from the groove, so that the extending member 19 is moved toward the oil pressure chamber 23 by the biasing force of the spring 20 as shown in FIG. 3*d*. At this time, the connecting member 18 does not return to the first guide bore 15 due to the frictional force induced between it and the first and second guide bores 25 and 27 by the pivoting motion of the first rocker arm 6 and the resisting force of the valve spring S2. When the next valve closed section Ac starts, the connecting member 18 is moved into the first guide bore 15 and by spring 13 the piston assembly 11 reverts to the state of FIG. 3.

By way of further explanation of the mechanism 8 and with reference to FIG. 5, the section At in which the trigger member 14 is disengaged from the extending member 19 is of a slightly shorter width in time than the valve opening section Ao. When the supply or release of oil pressure to or from the oil pressure chamber 23 is performed at time point t2 or t3 in that section At, the change-over operation of the connecting mechanism 8 is performed positively in the next valve closed section Ac. When the supply or release of oil pressure to or from the oil pressure chamber 23 is performed at any other time point than the above-described section At, for example, at time point t1, a positive change-over is performed in the next valve closing section Ac beyond one section Ao as indicated by the broken-line. Thus, the change-over always occurs at the start of a valve closed condition for assuring completion of the change-over before the start of a valve opening cycle.

What is claimed:

1. A valve operating mechanism for an internal combustion engine having camshaft, a pair of intake or exhaust valves for each engine cylinder and a rocker shaft, comprising, first and second rocker arms pivotally mounted on the rocker shaft in adjacent relationship and engaging said pair of valves, said first rocker arm engaging said camshaft, and piston means in said rocker arms selectively shiftable between positions connecting said rocker arms for pivotal movement in unison and disconnecting said rocker arms for independent movement, wherein said piston means includes two pistons slidably mounted in said first rocker arm with one piston slidable into said second rocker arm for connecting the first and second rocker arms.

2. The valve operating mechanism of claim 1 wherein said piston means includes a connecting piston slidably mounted in said first rocker arm for sliding movement parallel to said rocker shaft and selectively movable between a position extending between and connecting said first and second rocker arms to a position disconnecting said rocker arms.

3. The valve operating mechanism of claim 1 wherein said two pistons are provided with a compression spring there between for urging the pistons apart.

4. The valve operating mechanism of claim 3 wherein said piston means includes a plunger slidably mounted in said second rocker arm, and means are provided in said third rocker arm for continually and resiliently urging said plunger into engagement with said two pistons for urging said pistons toward the disconnecting position.

5. The valve operating mechanism of claim 1 wherein said first rocker arm is provided with a pressure chamber at an end of said two pistons opposite from said second rocker arm, and means are provided for selectively applying oil pressure on said chamber to urge one of said two pistons into said second rocker arm for the connecting position.

6. The valve operating mechanism of claim 1 wherein guide bores are provided in each rocker arm parallel to said rocker shaft and in axial alignment, and said piston means includes a separate piston slidably mounted in the guide bore of each rocker arm.

7. The valve operating mechanism of claim 6 wherein a pressure chamber is provided in said first rocker arm at an end opposite the second rocker arm, means for providing oil pressure to said chamber when said guide bores are aligned for causing the piston in said first rocker arm to move into connection with said second rocker arm, and spring means in said second rocker arm for urging the said pistons toward the chamber to return each of the pistons to a position within a rocker arm for disconnecting said rocker arms.

8. The valve operating mechanism of claim 1 wherein trigger means are provided for engaging and preventing the movement of said pistons, and means for releasing said trigger means for allowing the start of piston movement at a specific time in the camshaft rotation cycle.

9. The valve operating mechanism of claim 8 wherein said means for releasing said trigger means include separate cam on the camshaft for engaging and moving said trigger means to a piston releasing position during pivoting of said first rocker arm away from the valve closed positions.

10. The valve operating mechanism of claim 8 wherein trigger means are actuated and said piston means are released for movement prior to a valve closed position of said rocker arms and movement of said piston means between connect and disconnect conditions occurs during the valve closed position.

11. A valve operating mechanism for an internal combustion engine having a pair of intake or exhaust valves for each engine cylinder, comprising, a camshaft having a valve cam and a timing cam thereon, a rocker arm shaft having first and second rocker arms pivotally mounted thereon in adjacent relationship and engaging said pair of valves, said first rocker arm engaging said valve cam, piston means in said rocker arms selectively shifting between positions connecting said rocker arms for pivotal movement in unison and disconnecting said rocker arms for independent movement, and trigger means for engaging and preventing said shifting of said piston means, said trigger means engaging said timing cam for releasing said trigger means from said engagement with said piston means.

12. The valve operating mechanism of claim 11 wherein said piston means include two pistons slidably mounted in said first rocker arm for sliding movement parallel to said rocker shaft, and said two pistons selectively movable between a position extending between and connecting said first and second rocker arms to a position disconnecting said rocker arms.

13. The valve operating mechanism of claim 12 wherein said two pistons are mounted in said first rocker arm and biased apart, said piston means includes a plunger piston slidably mounted in said second rocker arm, and means are provided in said second rocker arm for continually and resiliently urging said plunger piston into engagement with said two pistons.

14. The valve operating mechanism of claim 11 wherein said first rocker arm is provided with a pressure chamber at an end opposite from said second rocker arm, a piston assembly is mounted in said first rocker arm, and means are provided for selectively applying oil pressure on said chamber to urge said piston assembly into said second rocker arm.

15. A valve operating mechanism for an internal combustion engine having a pair of intake or exhaust valves for each engine cylinder, comprising, a camshaft having a valve cam and a timing cam thereon, a rocker arm shaft having first and second rocker arms mounted thereon in adjacent relationship and engaging said pair of valves, said first rocker arm engaging said valve cam, piston means in said rocker arms selectively shiftable between positions connecting said rocker arms for pivotal movement in unison and disconnecting said rocker arms for independent movement, trigger means for engaging and preventing said shifting of said piston means, said timing cam engaging said trigger means for releasing said trigger means from said engagement with said piston means only during a rocking movement of said first rocker arm, and means for causing said selective shiftable movement of said piston means only while said rocker arms are not rocking.

* * * * *